US012072162B1

(12) United States Patent
Cozanitis

(10) Patent No.: US 12,072,162 B1
(45) Date of Patent: Aug. 27, 2024

(54) COMPACT GAS-OPERATED AUTOLOADING FIREARM MECHANISM

(71) Applicant: Mathew Cozanitis, Mount Annan (AU)

(72) Inventor: Mathew Cozanitis, Mount Annan (AU)

( * ) Notice: Subject to any disclaimer, the term of this patent is extended or adjusted under 35 U.S.C. 154(b) by 0 days.

(21) Appl. No.: 18/245,692

(22) PCT Filed: Oct. 5, 2022

(86) PCT No.: PCT/AU2022/051192

§ 371 (c)(1),
(2) Date: Mar. 16, 2023

(87) PCT Pub. No.: WO2023/077180

PCT Pub. Date: May 11, 2023

(30) Foreign Application Priority Data

Nov. 4, 2021 (AU) ..... 2021903530

(51) Int. Cl.
*F41A 9/22* (2006.01)
*F41A 5/18* (2006.01)
*F41A 5/34* (2006.01)
*F41A 9/55* (2006.01)

(52) U.S. Cl.
CPC ..... *F41A 9/22* (2013.01); *F41A 5/18* (2013.01); *F41A 5/34* (2013.01); *F41A 9/55* (2013.01)

(58) Field of Classification Search
CPC ..... F41A 9/55; F41A 9/22; F41A 9/00; F41A 9/01; F41A 9/06; F41A 9/07; F41A 9/09; F41A 9/20; F41A 5/34; F41A 5/18
USPC ..... 89/33.1; 42/18, 16, 17
See application file for complete search history.

(56) References Cited

U.S. PATENT DOCUMENTS 3,736,839 A * 6/1973 Childers ..... F41A 19/39 89/193
4,527,459 A * 7/1985 Childers ..... F41A 9/47 89/33.1
4,744,164 A * 5/1988 Rieger ..... F41A 9/17 42/18

(Continued)

FOREIGN PATENT DOCUMENTS

FR 2954820 A1 7/2011
KR 20080016981 A 2/2008
KR 101957452 B1 7/2019

OTHER PUBLICATIONS

International Search Report & Written Opinion dated Nov. 22, 2022 from PCT Application No. PCT/AU2022/051192.

*Primary Examiner* — John Cooper
(74) *Attorney, Agent, or Firm* — INNOVATION CAPITAL LAW GROUP, LLP; Vic Lin

(57) ABSTRACT

A gas-operated autoloading firearm mechanism has a compression chamber fluidly interfacing a barrel via a gas takeoff and a piston within the compression chamber which is urged rearwardly by combustion gas entering the compression chamber from the barrel during firing. The piston acts on a round carrier which moves relative to a bolt carrier. As such, the mechanism urges a round carrier rearwardly to strip a new round from the magazine and move the new round rearward behind a firing chamber. The mechanism urges a bolt carrier rearwardly away from the firing chamber to expel a spend case and to align the new round between a bolt assembly of the bolt carrier and the firing chamber so that, when the bolt carrier rebounds forward, the new round enters the firing chamber.

14 Claims, 2 Drawing Sheets

(56) References Cited

U.S. PATENT DOCUMENTS

2008/0121096 A1* 5/2008 Hajjar ..... F41A 9/74
89/14.3

* cited by examiner

COMPACT GAS-OPERATED AUTOLOADING FIREARM MECHANISM

FIELD OF THE INVENTION

This invention relates generally to autoloading firearm mechanism and, more particularly, this invention relates to compact gas-operated autoloading firearm mechanism.

BACKGROUND OF THE INVENTION

Gas-operated autoloading firearm mechanisms use a portion of high-pressure combustion gas from the cartridge being fired to power a mechanism to dispose of the spent case and insert a new round into the chamber.

Energy from the gas may be harnessed through either a port in the barrel or a trap at the muzzle. This high-pressure gas impinges on a surface such as a piston head to provide motion for unlocking of the action, extraction of the spent case, ejection, cocking of the hammer or striker, chambering of a fresh cartridge, and locking of the action.

The gas-operated AR-15 semi-automatic rifle employs a "direct gas impingement" (DGI) mechanism wherein the bolt carrier acts as a movable cylinder and the bolt itself acts as a stationary piston.

Gas is tapped from the barrel as the bullet moves past a gas port which via a gas tube into a "gas key" (bolt carrier key), which funnels the gas into the bolt carrier.

As the bolt is locked into the barrel extension by locking lugs the expanding gas forces the bolt carrier backward a short distance and thus unlocks it from the barrel extension. The bolt's rearward motion extracts the empty cartridge case from the chamber for ejection and, as the bolt carrier moves forward, a fresh round pushes up from the magazine which is guided into the chamber.

FR 2954820 A1 (Dolci) 1 Jul. 2011 discloses a weapon that has an adductor tube provided with vents. A lifting cartridge hopper positions ammunition opposite to an opening of a movable chamber. A percussion head with reduced mobility allows ejection, without damage of a case. The percussion head is actuated by the chamber at the end of the course. A locking device locks another percussion head to maintain the former head firmly when the chamber is closed again on the ammunition for shooting such that the ammunition is immobilized in the chamber.

The present invention seeks to provide an alternative gas-operated autoloading firearm mechanism, which will overcome or substantially ameliorate at least some of the deficiencies of the prior art, or to at least provide an alternative.

It is to be understood that, if any prior art information is referred to herein, such reference does not constitute an admission that the information forms part of the common general knowledge in the art, in Australia or any other country.

SUMMARY OF THE DISCLOSURE

There is provided a gas-operated autoloading firearm mechanism which taps combustion gas energy to urge a round carrier rearwardly to strip a new round from the magazine and move the new round rearward behind a firing chamber.

The energy is also used to urge a bolt carrier rearwardly away from the firing chamber to expel a spend case and to align the new round between a bolt assembly of the bolt carrier and the firing chamber so that, when the bolt carrier rebounds forward, the new round enters the firing chamber.

The energy may be tapped using a piston system essentially comprising a piston moving with respect to the round carrier with a piston recoil spring compressed therebetween and the round carrier moving with respect to the bolt carrier wherein the round carrier knocks the bolt carrier rearwardly and a bolt carrier recoil spring urges the bolt carrier forwardly again.

Apart from advantages of the working of the present autoloading mechanism, the present mechanism can create a weapon that is more compact and therefore lighter and manoeuvrable as compared to conventional firearm designs such as the AR-15 whilst maintaining muzzle velocity and effective range because the magazine can be located in front of the trigger and the round carrier moves new rounds back past the trigger to an action behind the trigger.

Furthermore, unlike the mechanisms taught by Dolci wherein the round carrier and bolt carrier move together, the present arrangement of the round carrier moving relative to the piston or the round carrier moving relative to the bolt carrier better harnesses the combustion gas energy by accommodating the relative inertia and differing travel distances of these components.

Other aspects of the invention are also disclosed.

BRIEF DESCRIPTION OF THE DRAWINGS

Notwithstanding any other forms which may fall within the scope of the present invention, preferred embodiments of the disclosure will now be described, by way of example only, with reference to the accompanying drawings in which.

DESCRIPTION OF EMBODIMENTS

Figure 1:
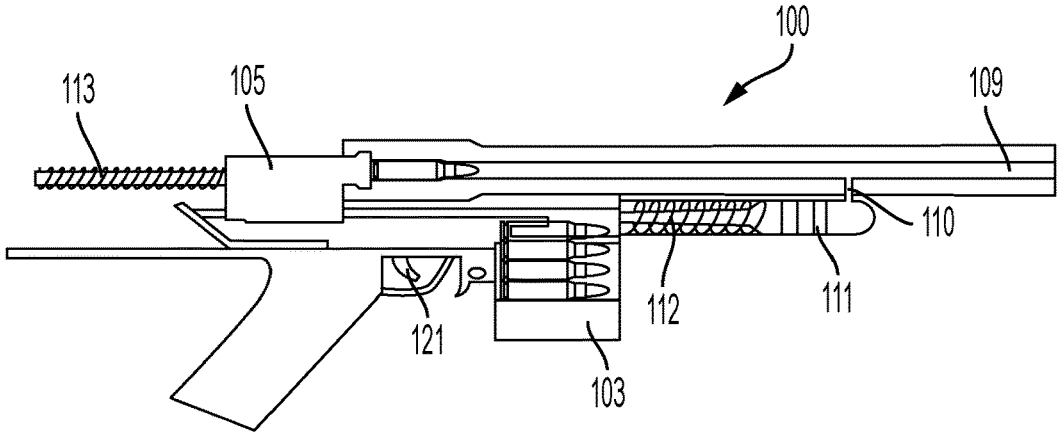
FIG. 1 shows a gas-operated autoloading firearm mechanism prior firing.
Figure 2:
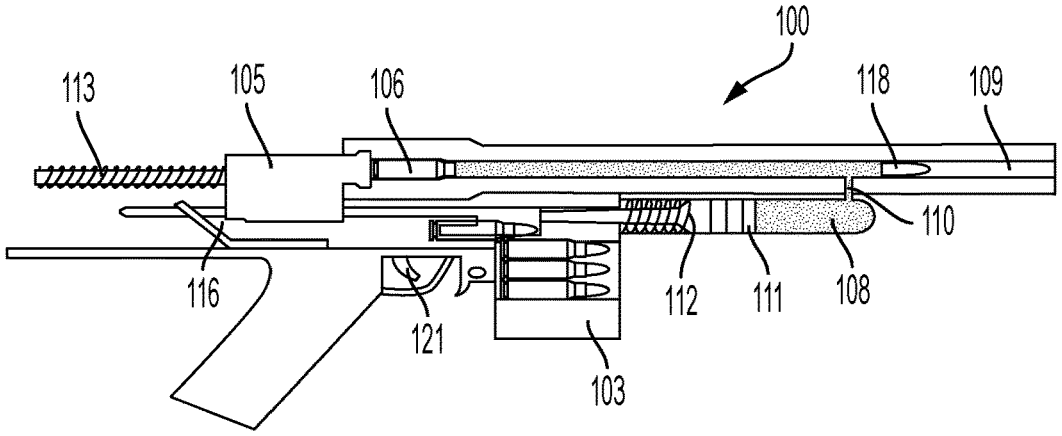
FIG. 2 shows the mechanism during firing.
Figure 3:
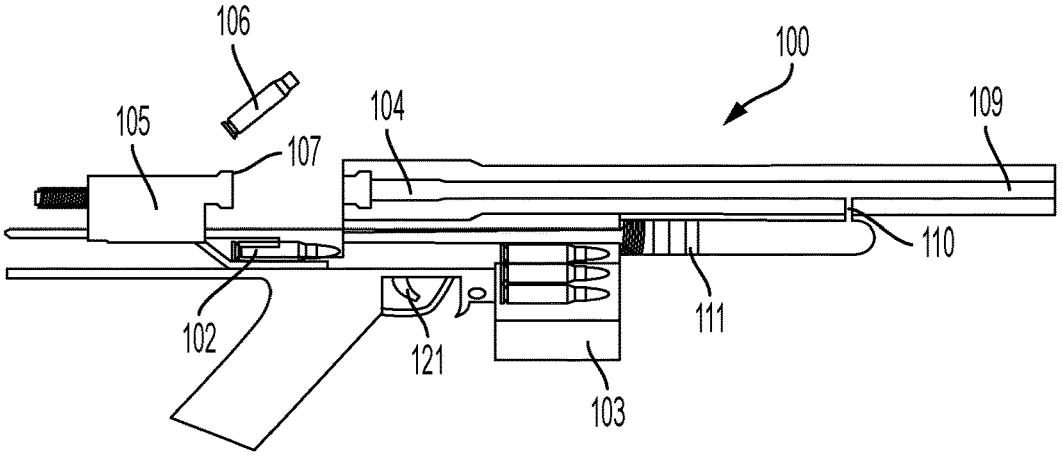
FIG. 3 shows the mechanism post firing.
Figure 4:
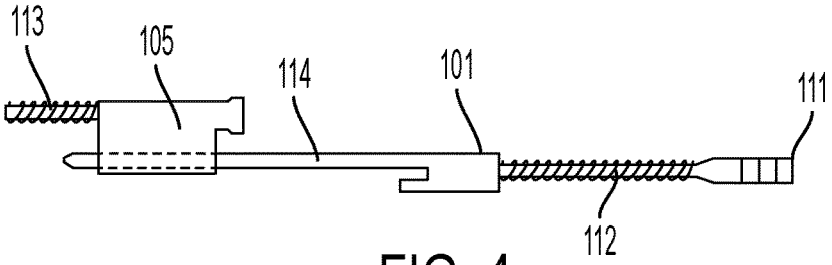
FIG. 4 illustrates the interconnection of a piston, round carrier and bolt carrier of the mechanism.

With reference to FIGS. 1-3, a gas operated autoloading firearm mechanism 100 taps combustion gas energy during firing to urge a round carrier 101 rearwardly to strip a new round 102 from a magazine 103 and to move the new round 102 behind a firing chamber 104.

The compressed gas energy is also used to urge a bolt carrier 105 rearwardly away from the firing chamber 104 to expel a spend case 106 and to align the new round 102 between a bolt assembly 107 of the bolt carrier 105 and the firing chamber 104 so that, when the bolt carrier 105 rebounds forward, the new round 102 enters the firing chamber 104.

The magazine 103 may be located forward of a trigger mechanism 121 and the round carrier 101 may bring new rounds 102 past the trigger mechanism 121 to an action behind the trigger mechanism 121.

The mechanism 100 may comprise a compression chamber 108 fluidly interfacing a barrel 109 via a gas takeoff 110. A piston 111 within the compression chamber may urged rearwardly by compressed gas entering the compression chamber 108 from the barrel 109 during firing as shown in FIG. 2. The piston 111 may comprise a piston head presenting a face within the compression chamber 108 which is impinged by the compressed gas and a drive rod.

It should be noted that other mechanisms may be employed to urge the round carrier rearwardly using compressed gas, including by direct impingement or even manual action.

Figure 6:
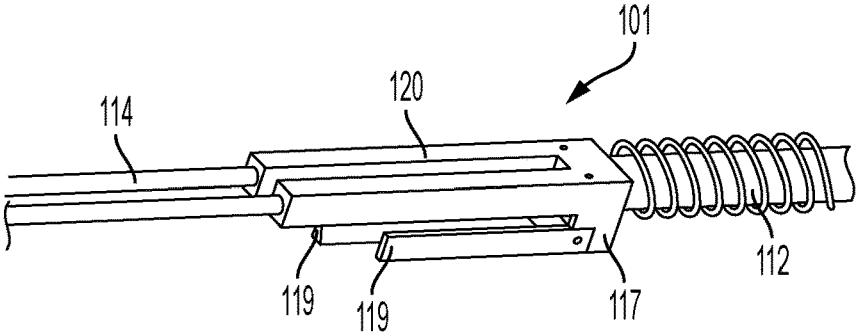
FIG. 6 shows a perspective view of the round carrier in further detail.
Figure 7:
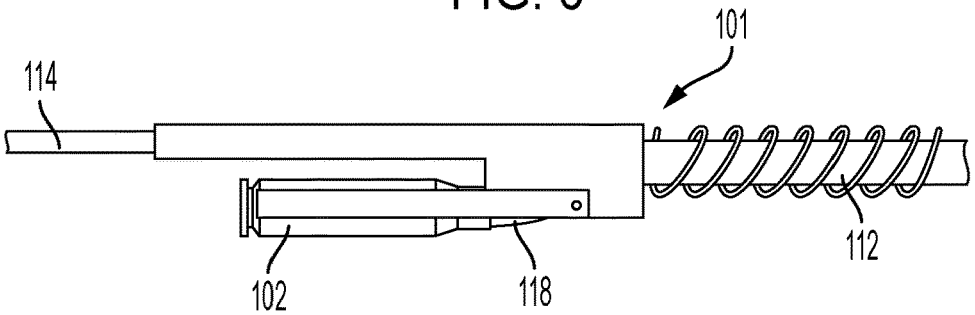
FIG. 7 shows a side view of the round carrier.
Figure 8:
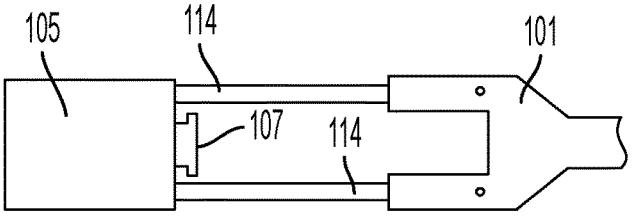
FIG. 8 shows a top plan view of the round carrier

With reference to FIGS. 6 and 7, the round carrier may comprise a monobloc 117 which pushes against a tip of a bullet 118 of the new round 102 to move the new round 102 rearwardly. Tines 119 may restrain lateral movement of the new round 102 and/or push against the base of the cartridge rim of the new round 102 to push the new round 102 rearward.

The round carrier 101 may be bifurcated to define a channel 120 through which the new round 102 can move up into alignment between the bolt assembly 107 and the chamber 104.

The round carrier 105 may move relative to the piston 111. A piston recoil spring 112 may be compressed between the piston head and a round carrier 101. A bolt carrier recoil spring 113 may urge the bolt carrier 105 forward.

Figure 5:
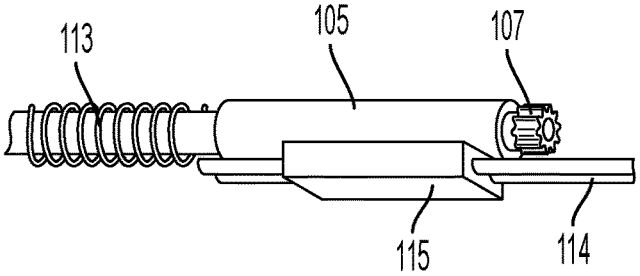
FIG. 5 shows the bolt carrier in further detail.

The round carrier 101 may knock the bolt carrier 105 rearward. Guide rods 114 may align the bolt carrier 105 and the round carrier 101. With reference to FIG. 5, the bolt carrier 105 may comprise a guide rod engagement 115 through which the guide rod 114 is slidably retained.

As is shown in FIG. 3, bolt carrier 105 may travel rearwardly away from an entrance of the firing chamber 104 a distance greater than a length of the new round 102.

The bolt carrier 105 may act on a lever 116 which pushes the new round 102 into alignment with the bolt assembly 107 when the bolt carrier 105 moves forward.

The foregoing description, for purposes of explanation, used specific nomenclature to provide a thorough understanding of the invention. However, it will be apparent to one skilled in the art that specific details are not required in order to practise the invention. Thus, the foregoing descriptions of specific embodiments of the invention are presented for purposes of illustration and description. They are not intended to be exhaustive or to limit the invention to the precise forms disclosed as obviously many modifications and variations are possible in view of the above teachings. The embodiments were chosen and described in order to best explain the principles of the invention and its practical applications, thereby enabling others skilled in the art to best utilize the invention and various embodiments with various modifications as are suited to the particular use contemplated. It is intended that the following claims and their equivalents define the scope of the invention.

The invention claimed is:

1. A gas-operated autoloading firearm mechanism comprising:

a compression chamber fluidly interfacing a barrel via a gas takeoff; and a piston within the compression chamber which is urged rearwardly by combustion gas entering the compression chamber from the barrel during firing to:

urge a round carrier rearwardly to:

strip a new round from the magazine; and move the new round rearward behind a firing chamber; and urge a bolt carrier rearwardly away from the firing chamber to:

expel a spend case; and to align the new round between a bolt assembly of the bolt carrier and the firing chamber so that, when the bolt carrier rebounds forward, the new round enters the firing chamber and wherein the round carrier moves relative to the bolt carrier.

2. The mechanism as claimed in claim 1, wherein the magazine is located in front of the trigger.

3. The mechanism as claimed in claim 2, wherein the new round is moved rearward past the trigger by the round carrier.

4. The mechanism as claimed in claim 1, wherein the round carrier moves relative to the piston.

5. The mechanism as claimed in claim 4, wherein a piston recoil spring is compressed between the piston and the round carrier.

6. The mechanism as claimed in claim 1, wherein a bolt carrier recoil spring urges the bolt carrier forward.

7. The mechanism as claimed in claim 6, wherein the round carrier knocks the bolt carrier rearward.

8. The mechanism as claimed in claim 1, wherein a guide rod aligns the bolt carrier and the round carrier.

9. The mechanism as claimed in claim 8, wherein the guide rod is slidably retained by the bolt carrier.

10. The mechanism as claimed in claim 1, wherein the bolt carrier travels rearwardly away from an entrance of the firing chamber a distance greater than a length of the new round.

11. The mechanism as claimed in claim 1, wherein the bolt carrier acts on a lever which pushes the new round into alignment when the bolt carrier moves forward.

12. The mechanism as claimed in claim 1, wherein the round carrier pushes against a tip of a bullet of the new round to move the new round rearwardly.

13. The mechanism as claimed in claim 1, when the round carrier comprises tines to laterally restrain the new round.

14. The mechanism as claimed in claim 1, wherein the round carrier forms an upper channel through which the new round moves into alignment between the bolt assembly and the firing chamber.

* * * * *